United States Patent [19]

Nelson

[11] Patent Number: 4,870,813

[45] Date of Patent: Oct. 3, 1989

[54] PLY-TWIST HEAT SET CARPET YARNS

[75] Inventor: Thomas L. Nelson, Georgetown, Del.

[73] Assignee: E. I. Du Pont de Nemours and Company, Wilmington, Del.

[21] Appl. No.: 201,890

[22] Filed: Jun. 3, 1988

Related U.S. Application Data

[62] Division of Ser. No. 58,215, Jun. 4, 1987, Pat. No. 4,779,408.

[51] Int. Cl.[4] ..... D02G 3/28; D02G 3/38

[52] U.S. Cl. ..... 57/204; 57/205; 57/236; 57/247

[58] Field of Search ..... 57/200, 204, 205, 236, 57/243, 246, 247, 282, 284, 290, 289, 293, 308, 350, 908

[56] References Cited

U.S. PATENT DOCUMENTS

| | | | |
|---|---|---|---|
| 3,011,243 | 12/1961 | Herrnstadt | 57/236 X |
| 3,299,486 | 1/1967 | Meyers et al. | 57/236 X |
| 3,438,193 | 4/1969 | Kosaka et al. | 57/144 |
| 3,491,527 | 1/1970 | Nelson | 57/284 |
| 3,603,068 | 9/1971 | Iida | 57/308 X |
| 3,710,565 | 1/1973 | Schnegg et al. | 57/247 X |
| 3,775,955 | 12/1973 | Shah . | |
| 3,968,638 | 7/1976 | Norton et al. | 57/140 |
| 4,074,511 | 2/1978 | Chambley et al. | 57/34 |
| 4,084,400 | 4/1978 | Movshovich et al. . | |
| 4,114,549 | 9/1978 | Chambley et al. . | |
| 4,148,179 | 4/1979 | Becker et al. | 57/350 |
| 4,173,861 | 11/1979 | Norris et al. | 57/293 |
| 4,246,750 | 1/1981 | Norris et al. | 57/204 X |
| 4,355,499 | 10/1982 | Takai | 57/205 |
| 4,355,592 | 10/1982 | Tajiri et al. | 57/205 X |
| 4,402,178 | 9/1983 | Negishi et al. | 57/205 |
| 4,408,445 | 10/1983 | Wilkie | 57/289 X |
| 4,434,275 | 3/1969 | Backer et al. | 57/139 |
| 4,452,160 | 6/1984 | Tajiri et al. | 112/410 |

FOREIGN PATENT DOCUMENTS

| | | |
|---|---|---|
| 2381119 | 10/1978 | France . |
| 61-44980 | 10/1986 | Japan . |
| 2022154 | 12/1979 | United Kingdom . |

OTHER PUBLICATIONS

U.S. Ser. No. 754,703, filed Jul. 15, 1985.
U.S. Ser. No. 817,385, filed Jan. 9, 1986.

*Primary Examiner*—Donald Watkins

[57] ABSTRACT

A ply-twisted crimped continuous filament yarn having at least 40 twist reversals per meter and particularly suited for freize style carpets and the process for making the yarn is disclosed.

9 Claims, 5 Drawing Sheets

PLY-TWIST HEAT SET CARPET YARNS

This is a division of application Ser. No. 07/058,215 filed June 14, 1987, now U.S. Pat. No. 4,779,408.

TECHNICAL FIELD

This invention relates to a carpet yarn especially suitable for friezé style carpets wherein the yarn has at least 40 twist reversals per meter and the process for making the yarn.

BACKGROUND

Yarns to be used as pile in cut pile carpets are conventionally ply twisted from two or more component carpet yarns in a true twisting operation which operates at a relatively low linear speed of about 40 to 70 yards (37 to 64 meters) per minute. The plied yarns are then heated by steam while relaxed on a moving belt in an enclosure for sufficient time to heatset the yarns in the ply twisted configuration so that when they are tufted into carpet and cut, the plies will remain in their twisted condition without separating and matting during wear.

Various ways of preparing yarns for cut pile have been proposed to produce yarns at higher speeds yet obtain adequate tuft integrity. The process of Norton and Windley U.S. Pat. No. 3,968,638 entangles the yarn or yarns highly in a hot fluid entangling jet then heatsets the yarn in a twisted condition by a fluid false twisting jet and heater so that although the yarn has substantially no twist while it is wound on a package, the yarn will return to its twisted configuration when the pile yarn is cut and heated during dyeing, thus producing coherent twisted tufts in the final carpet.

A yarn which is plied by false twisting each of two or more yarns, joining them together, and permitting the yarns to ply twist together is described in Chambley and Norris U.S. Pat. No. 4,074,511 and related patents. Coherent yarn may also be prepared by false twisting and heat adhering a thermoplastic carpet yarn in accordance with Tajiri et al U.S. Pat. Nos. 4,355,592 and 4,452,160. All of the above references have the object of producing cut pile tufts having tips of substantially equal coherency so that the carpet has a uniform surface appearance of coherent tufts.

A particular type of carpet known as "friezé" is made by ply-twisting two or more yarns with a higher degree of ply twist than singles twist. When such yarn is heat set in skein form, the unbalanced twist causes the yarn to form kinks known as "twist pigtails" and to be heat set in this configuration. After such yarn is tufted into cut pile carpet, the plies of tufts which are cut at a pigtail location separate at least slightly and at least one ply forms a curl in the plane of the carpet surface, while tufts which are cut elsewhere form coherent tuft tips. This varied surface appearance is desired for some styles of carpets, but the need for higher twist makes the yarn process even slower and more expensive than usual twist plying.

SUMMARY OF THE INVENTION

A ply-twist yarn suitable for cut-pile carpets characterized by an average of at least 40 twist reversals per meter has now been discovered. The yarn preferably has preferably less than 8 and more preferably 1–5 turns of heatset twist between each twist reversal and at least one turn of heatset twist per inch (2.54 cm). The component yarns that are ply twisted together to form the yarn of this invention are not adhered to or bonded to each other. The twist reversals are maintained due to heatset twist and the yarns should not be bonded at the twist reversals or elsewhere. A friezé style carpet made from the yarn of this invention is characterized by having tuft tips wherein greater than 10% of the tufts form at least a 60° curl and are compact and heatset into a twisted configuration and greater than 10% of the tufts are separated. When such yarn is tufted into cut pile carpets, those tufts which are cut at the twist-cohered regions will have compact tuft tips while those which are cut at a non-cohered twist reversal will separate into the component yarns and at least one of the separated components will curl to some extent in or near the plane at the carpet surface. The curls are seen scattered randomly against a background of compact tufts which absorb light and appear darker than their actual color. This unusual and pleasing appearance has not previously been available. In addition, the separated and curled tips give a softer surface tactility than is characteristic of usual cut pile. The visual effect may be heightened by providing component yarns of contrasting color, shade or dyeability.

By "compact" it is meant that the diameter of the cut tuft tip is no more than 2X the diameter of the tuft at its midpoint.

When yarn of the invention is made into a cut pile carpet, dyed and finished, at least 10% of the tuft tips are compact and heatset into a twisted configuration, and in at least 10% of the tuft tips the component yarns have separated. At least 5% of the separated components may form at least a 60° curl when viewed perpendicular to the surface.

It can be seen that the character of the carpet can be varied by varying the numbers of turns of twist in the twisted sections and the distance from one reversal to the next. A yarn having long distances between reversals will give mostly compact tuft tips and few separated tips when in carpet. A yarn having short distances between reversals will give mostly separated and few compact tips when in carpet. Using a particular yarn in short-pile carpet will give a greater frequency of compact tips than the same yarn in long-pile.

While the yarns of the invention usually display sections of opposite twist separated by a twist reversal, some sections of the same hand twist are separated by two reversals in sequence, but sections of opposite hand twist occur further along the length of the yarn.

The process for making the yarn of this invention which is especially suitable for friezé type carpets comprises the steps of:

(a) feeding two or more crimped continuous filament yarns under tension through separate close-fitting passages of a guide into a steam chamber;

(b) impinging saturated steam preferably substantially free of entrained water on the axis of the chamber;

(c) passing the yarns through a close-fitting tube;

(d) twisting the yarns in a torque jet wherein the torque jet comprises a jet air passage tangentially connected to a yarn passage having a diameter of greater than 0.35 cm and a housing and wherein the close-fitting tube is aligned with and offset towards one side of the yarn passage wherein the maximum width of the intersection of the close-fitting tube and the yarn passage is greater than about 0.076 cm and wherein the yarns are twisted back to the close-fitting passages; and (e) cooling the twisted yarns.

The offset is greater than about 0.076 cm and less than about 0.14 cm. The close-fitting tube is insulated and is at least 30 cm long. In a preferred process a spacer is inserted creating a gap between the torque jet and the close-fitting tube. The twisted yarns are preferably passed through puller rolls and the distance between the exit of the torque jet and the puller rolls is at least 43 cm. The yarns are overfed during the cooling step and the yarn is wound at greater than 137 mpm (150 ypm).

The difference between the speeds of the feed rolls and puller rolls preferably provides sufficient overfeed to describe a helical cranking mode after exiting from the torque jet. The yarn after leaving the puller rolls may be relaxed as on a moving belt and may be cooled with water.

Thus, carpets having a friezé appearance may be made from yarns which are processed at 137 mpm or more, at least 2X to 4X the normal speed for making friezé yarns.

It has now also been found that the distance between false twist reversals may be influenced by varying the diameter of the yarn passage in the torque jet. A small passage diameter less than about 3.81 mm promotes twisting of the yarn along the axis of the yarn line with a minimum of cranking within or outside of the jet, and this action correlates with a relatively large number of undirectional turns of twist between twist reversals and long distance between reversals. A relatively large passage diameter allows space for the yarn to crank within the passage and outside of the torque jet exit as shown in FIG. 9.

This cranking action correlates with small number of unidirectional turns of twist and short distance between twist reversals. For carpet yarns having a total denier of about 2000 to 8000, optimum cranking is produced by jets having a yarn passage diameter of about 3.81 to 6.35 mm.

Cranking is also promoted by overfeed in the yarn as it moves through the torque jet. Optimum overfeed for cranking is about 8 to 30%.

BRIEF DESCRIPTION OF THE DRAWINGS

FIGS. 2 and 3 are two views of yarn segregation guide 3 of FIG. 1.

DETAILED DESCRIPTION OF THE DRAWINGS

Figure 1:
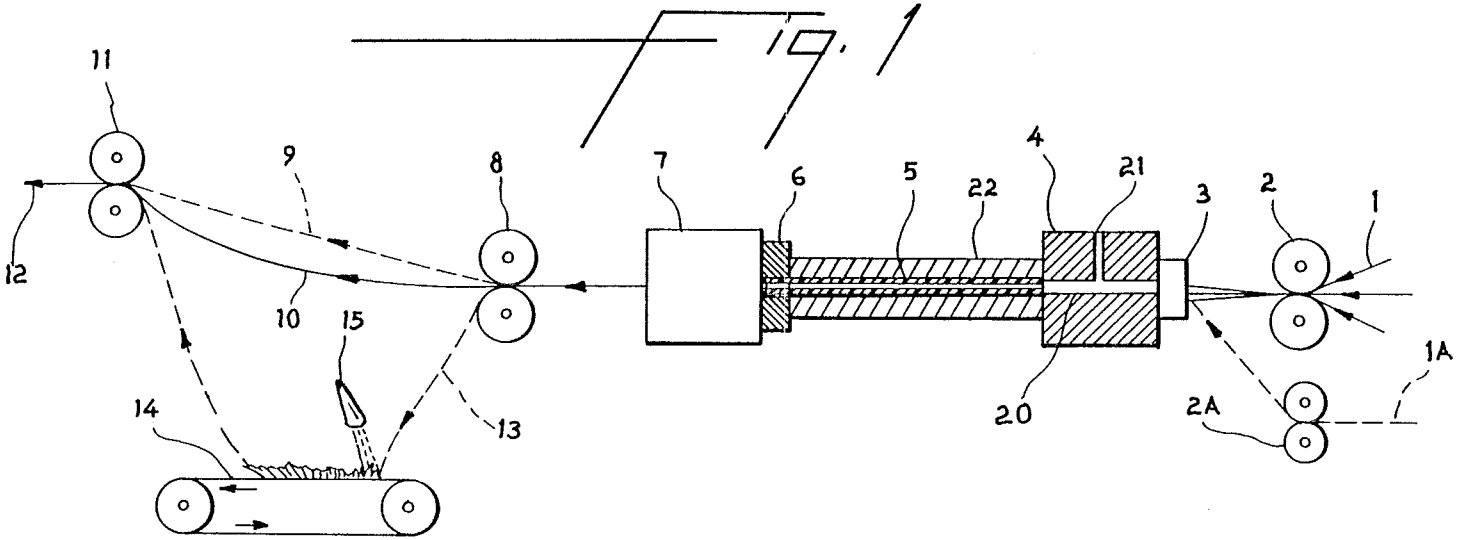
FIG. 1 is a schematic view of the process of the invention.

Referring to FIG. 1, two or more crimped carpet yarns 1 are led from yarn packages through tension devices which control the tension on each and are passed together through powered feed rolls 2 which grip yarns 1 and feed them into the process at a desired rate. Alternatively, if one or more of the yarns is to be fed at a different rate, a separate set of feed rolls 2A may be used to feed yarn or yarns 1A.

Figure 2:
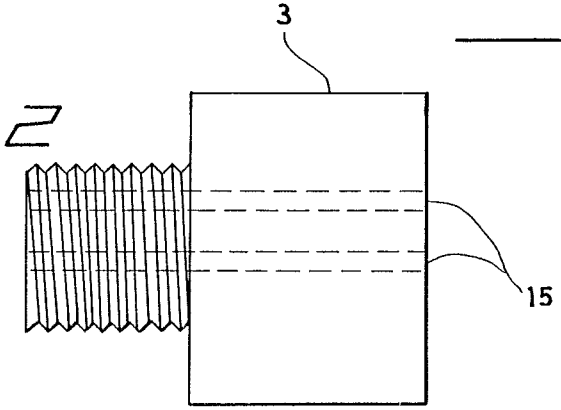
Figure 4:
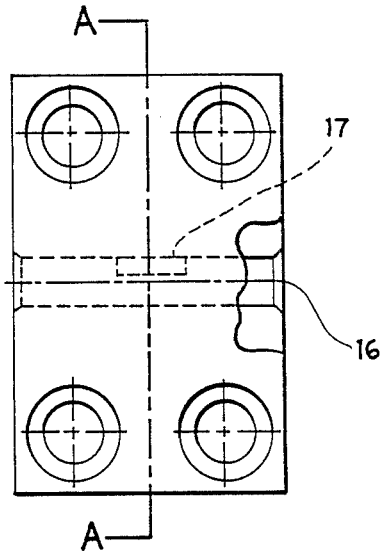

The yarns then enter segregation guide 3, shown in more detail in FIGS. 2 and 3, having yarn passages 15 each sized to pass a single yarn 1 and also to prevent excessive escape of steam from steam jet block 4. This guide acts as a twist trap to prevent twist from progressing upstream.

Steam jet block 4 has a cylindrical chamber 20 wherein steam orifice 21 directs steam at the axis of chamber 20 to heat the combined yarns which are twisted together at the impingement point due to backup of twist imparted to the yarns by torque jet 7. Since the yarns are preferably overfed by setting the speed of puller rolls 8 less than feed rolls 2, the steam may blow the yarns apart to some extent and heat at least the exterior of the yarn bundles to a temperature sufficient to set the twist, but the twist prevents any substantial separation of the individual filaments and penetration of the individual yarns by the steam. Saturated steam substantially free of entrained water is preferred for maximum rate of heat transfer and is important for proper dye transfer. Downstream tube 5 has an inside diameter just sufficient to pass the combined yarns, the length of tube 5 being sufficient to permit the yarns to reach twist setting temperature at commercially desirable feed rates and also to seal against excessive steam outflow while maintaining a desired steam saturation temperature and pressure within chamber 20. Tube 5 is surrounded by thermal insulation 22.

The downstream end of tube 5, is in touching contact with the upstream face of torque jet 7. Steam may either pass with the yarn through torque jet 7 or may exit through a gap between the two elements. The alignment between the exit of tube 5 and the entrance of the yarn passage in torque jet 7 is adjusted by aligning means 6 shown in FIG. 8A.

Figure 9:
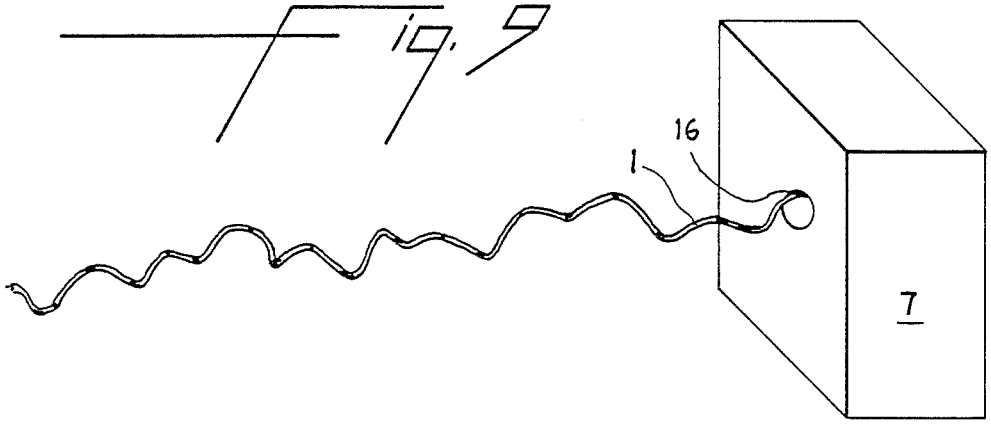
FIG. 9 is a drawing made from a high-speed flash photograph of yarn emerging from torque jet 7 in a cranking mode.

As the twisted yarns exit from torque jet 7, they require a certain travel distance through ambient air to cool partially. Also, one preferred mode of operation of the process requires that the yarns display a helical cranking path as shown in FIG. 9 which is promoted by providing a substantial distance between the exit of torque jet 7 and puller rolls 8, preferably at least 43.2 cm.

After leaving the puller rolls, the yarn cools further under either tension, as indicated by yarn path 9, or relaxation, as indicated by yarn paths 10 and 13, the yarn product characteristics being different as described below. Complete relaxation, if desired, may be obtained by accumulating the product on travelling belt 14 where it cools either in ambient air or with the aid of water spray from nozzle 15. The speed of take-up rolls 11 with respect to puller rolls 8 determine the tensioned or relaxed state of the yarns in between. The yarn then proceeds under suitable winding tension to a windup 12 (not shown).

Figure 4:
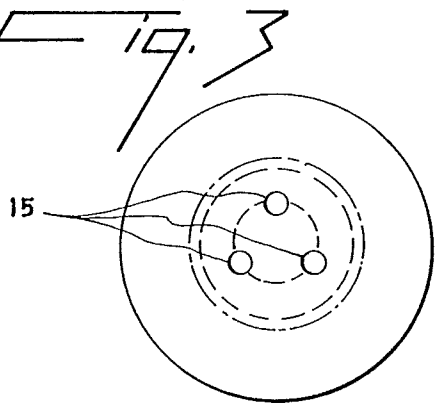
FIGS. 4 and 5 are two views of torque jet 7 of FIG. 1.
Figure 5:
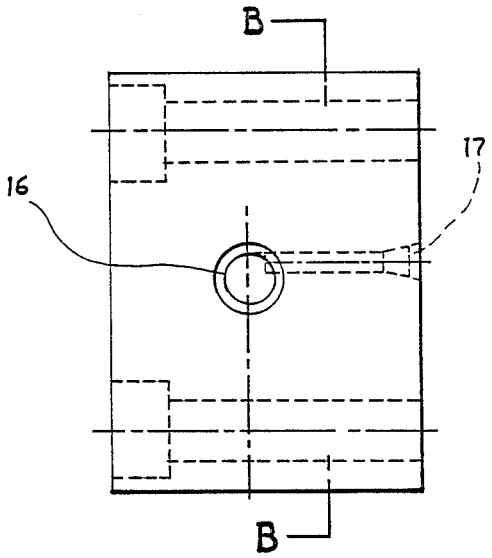
Figure 6:
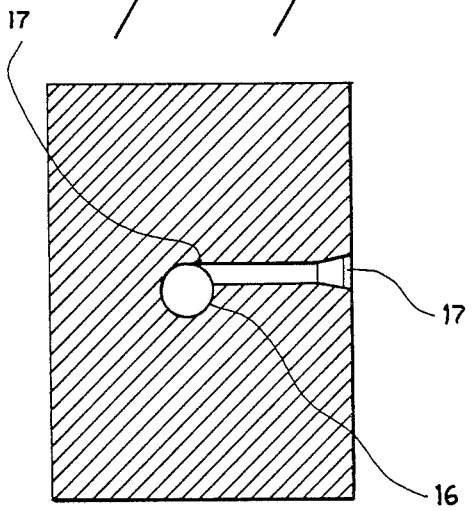
FIG. 6 is a cross section of torque jet 7 taken at A—A of FIG. 4.
Figure 7:
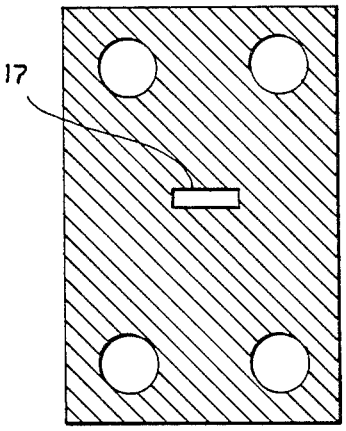
FIG. 7 is a cross section of torque jet 7 taken at B—B of FIG. 5.

FIGS. 4 and 5 are two views of torque jet 7 showing cylindrical yarn passage 16 intercepted at its midpoint by rectangular air passage 17 fed from a source of pressurized air (not shown). FIG. 6 is a cross section taken at A—A in FIG. 4, and FIG. 7 is a cross section taken at B—B of FIG. 5.

Figure 8A:
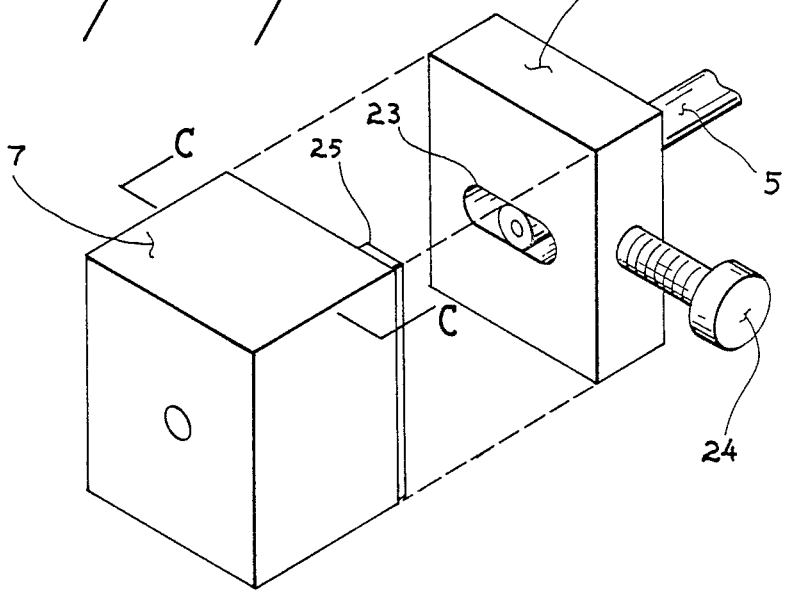
FIG. 8A is a detail schematic of aligning means 6 of FIG. 1 for adjusting the positions of the exit of steam tube 5 with respect to the entrance of torque jet 7.

Referring to FIG. 8A, the downstream end of tube 5 is supported in an elongated groove 23 where it is held between adjusting screw 24 and a compression spring (not shown) at the opposite end of groove 23 and on the same center line as screw 24 which forces tube 5 toward screw 24. Torque jet 7 is secured to aligning means 6 by screws (not shown) which pass through spacer 25 which forms a gap between the two components for part of the steam to escape.

Figure 8B:
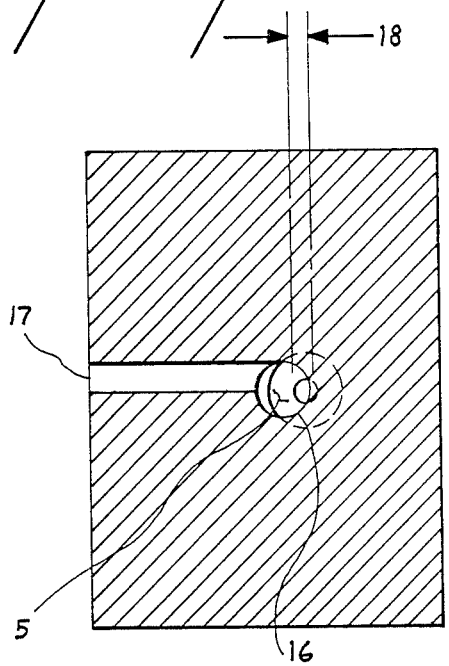
FIG. 8B is a cross section of torque jet 7 at C—C of FIG. 8A showing a preffered alignment of steam tube 5.

FIG. 8B shows a cross section of torque jet 7 taken at C—C of FIG. 8A showing a preferred alignment of the end of tube 5 with respect to torque jet air passage 17 and yarn passage 16. The central bore of tube 5 is moved toward the side of yarn passage 16 away from air passage 17 until the maximum width 18 to the intersection of the inner diameters of tube 5 and yarn passage 16 is within the limits specified. The maximum width, dimension 18 may be set easily by first centering the bore of tube 5 with respect to yarn passage 16, inserting a cylindrical bar of diameter 18 through 16 into the bore of 5 and then turning adjusting screw 24 until the bar is gripped between the two elements and then removing the cylindrical bar.

Figure 8C:
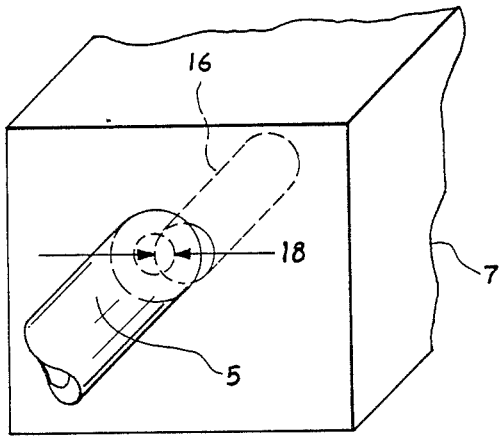
FIG. 8C is a view of the maximum width, dimension 18.

FIG. 8C shows a different view of the intersection of tube 5 and yarn passage 16 and more clearly shows the maximum width dimension 18. The torque jet air passage is not shown in FIG. 8C.

FIG. 9 is a drawing made from a high speed flash photograph of yarn 1 emerging from the exit of yarn passage 16 of torque jet 7 and travelling from right to lett. The helical cranking mode shown appears to promote short sections of unidirectional twist in the yarn product and short distances between non-cohered sections at twist reversals.

Figure 10:
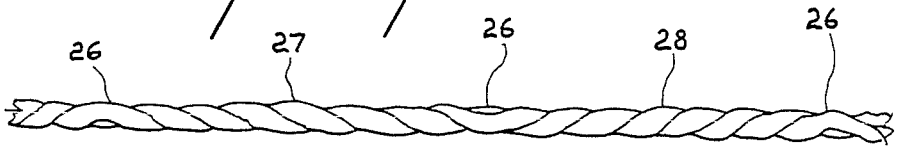
FIG. 10 is an enlarged side view of a typical yarn made by the process of the invention.

FIG. 10 is an enlarged side view of a typical yarn of the invention. Progressing from left to right, twist reversal 26 is followed by a number of turns of Z twist 27, another twist reversal 26, a roughly equal number of turns of S twist 28, and so on.

Figure 11:
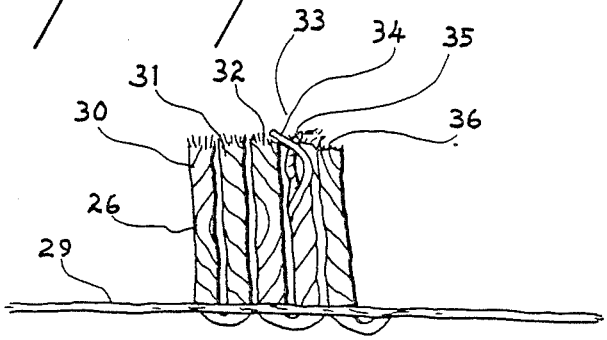
FIG. 11 is an enlarged side view of a cut pile carpet made from a yarn of the invention.

FIG. 11 shows an enlarged side view of a cut pile carpet tufted from a yarn such as is shown in FIG. 10. Tuft 30 contains a twist reversal 26 but has been cut at a region containing heat set twist so that the tuft tip remains compact. Tuft 31 contains twist of a single direction. Tuft 32 is similar to tuft 30, containing a twist reversal but being cut at a twisted area. Tuft 33 has been cut at a twist reversal, and the component yarns 34 and 35 have separated. In a vertical view, one or both of these would be seen as curls. Tuft 36 again contains single-direction twist. The differing number of turns of twist between twist reversals gives a random occurrence of curls.

Figure 12:
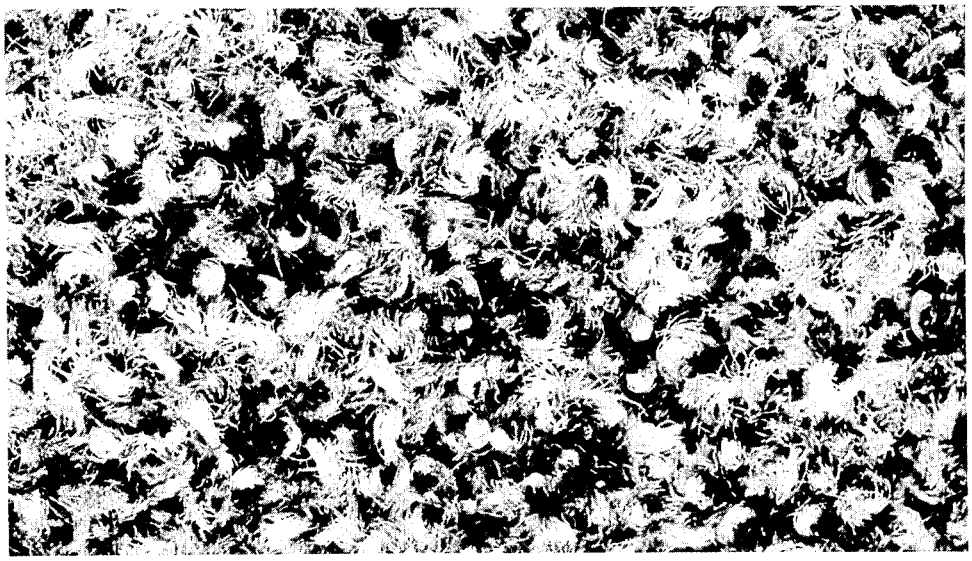
FIG. 12 is an enlarged view taken perpendicular to the surface of a carpet made from a yarn of the invention.

FIG. 12 is an enlarged vertical view of the surface of a cut pile carpet made from a yarn of the invention. One of the component yarns is lighter color to accentuate the appearance of curls, which range from about 60°–120° of a circle. Although compact tuft tips are a majority, the curls are so obvious that the compact tufts are less noticeable.

It is preferred that the steam heating conditions be sufficient to set twist in the yarns but not to adhere filaments to one another. The coherence in the twisted sections is preferably from the heatset twist alone. Adherence of filaments which would inhibit separation of the yarns at the twist reversals is not desired.

The degree of tension in the yarn as shown in FIG. 1 by yarn path 9 or relaxation as shown by path 10 or 13 influences the tightness of the twist or compaction of the yarn in the twisted sections as well as the tendency of the component yarns to separate at the twist reversals. Relaxation gives tighter twist and greater compaction in the twisted regions along with a greater tendency for the component yarns to separate when cut at or near twist reversals, and also a greater tendency to form curls at the carpet surface. Tension gives bulkier yarn having lower degree of twist, less tendency for the yarns to separate at reversals and fewer curls, thus giving a more conventional appearance with predominately compact tuft tips when made into cut pile carpet. Adjusting the speed of rolls 11 with respect to rolls 8 can provide yarn characters between the above extremes.

TEST METHODS

Compact Tufts and Curls

A section of cut pile carpet which has not been subjected to wear 10 pile tufts on each side (100 tufts total) is cut from a larger sample. The number of tuft tips which are distinctly compact are counted. The remainder are considered to be separated. The separated tuft tips which form at least a 60° curl as seen in the photograph are also counted as curls. The degree of curl is measured beginning at what appears to be a straight section before the curled end.

Twist Reversals Per Meter

A sample of yarn longer than one meter is clamped at one end and laid on a horizontal meterstick, the other end being attached to a light weight hanging vertically from the other end of the meterstick. The number of reversals in the measured meter of yarn is counted and recorded.

EXAMPLES

The arrangement of FIG. 1 is used for each of the following examples, the details being as follows unless otherwise specified: Tension in each yarn 1 approaching Feed Rolls 2–10 gms Diameter of yarn passages 15 in segregation guide 3–1.02 mm Diameter of chamber 20 in steam jet block 4–3.25 mm Length of chamber 20 in steam jet block 4–25.4 mm Diameter of steam orifice 21–2.51 mm Diameter of tube 5–2.24 mm Length of tube 5–305 mm Diameter of yarn passage 16 in torque jet 7B–3.18 mm Diameter of yarn passage 16 in torque jet 7C–4.75 mm Dimensions of air orifice 17 in torque jet 7B–1.27×3.68 mm Dimensions of air orifice 17 in torque jet 7C–2.03×6.35 mm Distance from torque jet 7 to puller rolls 8–43.2 cm Distance from puller rolls 8 to takeup rolls 11–63.5 cm The supply yarns from the left, center and right creels are 1200 denier, 2.3 modification ratio solution dyed nylon BCF.

Examples 1–4

Examples 1, 2, and 3 employ torque jet 7C having a relatively large diameter yarn passage 16. The yarns leaving the exit of yarn passage 16 are highly agitated, which when viewed by high speed photography or strobe light are seen to be in helical cranking mode as shown in FIG. 9. The envelope of the agitated yarn path is about 1.27–2.54 cm. In Example 4 using torque jet 7B having a small diameter yarn passage 16, the envelope of the yarn path is about 1 cm or less. Even though the torque jet air pressure is 3.52 kg/cm$^2$ compared to 2.81 for Examples 2 and 3, the reversals per meter for this yarn are 32, only about half the reversals for Examples 2 and 3.

In Example 1, the yarn feed tension is 30 gms on the left creel supply and 22 on the other two vs. 10 gms for Examples 2 and 4 and 12 gms for Example 3. Two supply yarns are overfed by a greater amount than the other two. The yarn has 56 reversals per meter.

In Examples 1–4, the maximum yarn width, Dimension 18 is 0.096 cm, on the right-hand side of yarn passage 16. In Example 2, the yarn has 65 twist reversals per meter, the maximum for this series of tests. Example 3 uses slightly higher feed tensions which reduces the twists slightly.

Examples 5–11

Examples 5–11 show the effect of offsetting the end of tube 5 with respect to yarn passage 16 by different degrees. In these experiments, tube 5 is displaced to the left-hand side of yarn passage 16, toward the air passage 17. Yarns are made at the processing conditions shown with the degrees of offset shown in Table 2.

When Dimension 18 of FIG. 8B is 0.076 cm or less, the yarn is pinched and will not run. Yarn samples are made at the other settings and the number of reversals per yard are recorded. It can be seen that the maximum number of reversals occurs at Dimension 18 between about 0.089 and 0.102 cm and declines to a minimum when tube 5 is centered and coaxial with yarn passage 16.

TABLE 1

| TRACER TAPE | EXAMPLE 1 | EXAMPLE 2 | EXAMPLE 3 | EXAMPLE 4 |
|---|---|---|---|---|
| Left Creel Supply | Rose | Tan | Tan | Tan |
| Creel Tension, GR | 10 | 10 | 10 | 10 |
| Feed Tension, GR | 30 | 10 | 12 | 10 |
| Entry Bore No. | 2 | 2 | 2 | 2 |
| MPM | 198 | 212 | 212 | 212 |
| Center Creel Supply | Plum | Tan | Tan | Tan |
| Creel Tension. GR | 10 | 10 | 10 | 10 |
| Feed Tension, GR | 22 | 10 | 12 | 10 |
| Entry Bore No. | 1 | 1 | 3 | 3 |
| MPM | 212 | 212 | 212 | 212 |
| Right Creel Supply | Tan | Tan | Tan | Tan |
| Creel Tension, GR | 10 | 10 | 10 | 10 |
| Feed Tension, GR | 22 | 10 | 12 | 12 |
| Entry Bore No. | 3 | 3 | 3 | 3 |
| MPM | 212 | 212 | 212 | 212 |
| Inlet Segregation Tube | | | | |
| Bore (dia)-cm | 0.102 | 0.102 | 0.102 | 0.102 |
| Length-cm | 1.91 | 1.91 | 1.91 | 1.91 |
| Steam Jet | | | | |
| Passageway | 0.325 | 0.325 | 0.325 | 0.325 |
| Orifice | 0.251 | 0.251 | 0.251 | 0.251 |
| Downstream Tube | | | | |
| Dia-cm | 0.224 | 0.224 | 0.224 | 0.224 |
| Length-cm | 30.5 | 30.5 | 30.5 | 30.5 |
| Torque Jet | | | | |
| Type | 7C | 7C | 7C | 7B |
| Air Prssure, kg/cm$^2$ | 3.52 | 2.81 | 2.81 | 3.52 |
| Volume,Liters/min | 411 | 368 | 368 | 170 |
| Puller Roll, MPM | 183 | 183 | 183 | 183 |
| Overfeed, % | (differential) | 16 | 16 | 16 |
| Take Up Roll, MPM | 175 | 181 | 180 | 181 |
| Tension Zone, GR | Slack | Slack | Slack | Slack |
| Winding Tension, GR | 75 | 75 | 75 | 75 |
| Steam Supply, kg/cm$^2$/°C. | 3.89 | 3.73 | 3.73 | 3.52 |
| Manifold T/C, °C. | 141 | 145 | 145 | 144 |
| Jet Passageway, Steam Conditions kg/cm$^2$/°C. | 2.81 | 3.23 | 3.23 | 3.09 |
| Product Denier | 4050 | 4100 | 4210 | 4030 |
| Max. Width, Dimension 18-cm | 0.097 | 0.097 | 0.097 | 0.097 |
| Twist Reversals per yard | 56 | 65 | 60 | 32 |

Note: Tube/Torque Jet axis offset with 0.097 cm gauge pin on side opposite torque jet air orifice.

TABLE 2

| EXAMPLE | DIMENSION 18 (FIG. 8B) | TWIST REVERSALS PER YARD |
|---|---|---|
| | 0.076 cm | — |
| 5 | 0.089 cm | 58 |
| 6 | 0.102 cm | 63 |
| 7 | 0.114 cm | 48 |
| 8 | 0.127 cm | 47 |
| 9 | 0.140 cm | 34 |
| 10 | 0.152 cm | 33 |
| 11 | Centered | 32 |

TABLE 3

| EXAMPLES 5-11 | |
|---|---|
| TRACER TAPE | |
| Left Creel Supply | Plum |
| Creel Tension, GR | 15 |
| Feed Tension, GR | 10 |
| Entry Bore No. | 2 |
| MPM | 212 |
| Center Creel Supply | Rose |
| Creel Tension, GR | 15 |
| Feed Tension, GR | 10 |
| Entry Bore No. | 1 |
| MPM | 212 |
| Right Creel Supply | Tan |
| Creel Tension, GR | 15 |
| Feed Tension, GR | 10 |
| Entry Bore No. | 3 |
| MPM | 212 |
| Inlet Segregation Tube | |
| Bore | 0.102 |
| Length | 1.91 |
| Marq. Jet | |
| Passageway (dia)-cm | 0.325 |
| Orifice (dia)-cm | 0.251 |
| Downstream Tube | |
| Dia-cm | 0.224 |
| Length-cm | 30.5 |
| Torque Jet | |
| Type | 7C |
| Air Pressure, kg/cm$^2$ | 2.81 |
| Volume, Liters/min | 368 |
| Puller Roll, MPM | 183 |
| Overfeed, % | 16 |
| Take Up Roll, MPM | 180 |
| Tension Zone, GR | Slack |
| Winding, Tension, GR | 70 |

TABLE 3-continued

| EXAMPLES 5-11 | |
|---|---|
| TRACER TAPE | |
| Steam Supply, kg/cm$^2$/°C. | 3.44/147 |
| Manifold T/C, °C. | 143 |
| Jet Passageway Steam Conditions kg/cm$^2$/°C. | 2.88/142 |
| Product Denier | 4100 |

I claim:

1. A ply-twisted crimped continuous multifilament yarn suitable for cut-pile carpets characterized by at least 40 twist reversals per meter.

2. The yarn of claim 1 further characterized by the yarn not being bonded at the twist reversals.

3. The yarn of claim 2 further characterized by having less than 8 turns of heatset twist between each twist reversal.

4. The yarn of claim 3 further characterized by having at least one turn of heatset twist per 2.5 cm.

5. The yarn of claim 5 wherein the yarn has 1–5 turns of heatset twist between each twist reversal.

6. The yarn of claim 5 wherein the yarn is a polyamide yarn.

7. A friezé style carpet made from any of the yarns of claims 1–6 characterized by having tuft tips wherein greater than 10% form at least 60° curl and are compact and heatset into a twisted configuration and greater than 10% are separated.

8. A ply-twisted yarn suitable for cut-pile carpets and formed from a plurality of crimped continuous multifilament yarns where the ply-twisted yarn is characterized by at least 40 twist reversals per meter.

9. The ply-twisted yarn of claim 8 where the number of multifilament yarns is three.

* * * * *

UNITED STATES PATENT AND TRADEMARK OFFICE

CERTIFICATE OF CORRECTION

PATENT NO. : 4,870,813

DATED : October 3, 1989

INVENTOR(S) : THOMAS L. NELSON,

It is certified that error appears in the above—identified patent and that said Letters Patent is hereby corrected as shown below:

Column 10:
Claim 5, line 1, delete "claim 5" and insert in place thereof -- claim 4 --.

Signed and Sealed this

Fourteenth Day of August, 1990

*Attest:*

*Attesting Officer*

HARRY F. MANBECK, JR.

*Commissioner of Patents and Trademarks*